US010382849B2

(12) United States Patent
Laitinen et al.

(10) Patent No.: US 10,382,849 B2
(45) Date of Patent: Aug. 13, 2019

(54) SPATIAL AUDIO PROCESSING APPARATUS

(71) Applicant: Nokia Technologies Oy, Espoo (FI)

(72) Inventors: Mikko-Ville Laitinen, Helsinki (FI); Mikko Tammi, Tampere (FI); Miikka Vilermo, Siuro (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/742,240

(22) PCT Filed: Jul. 5, 2016

(86) PCT No.: PCT/FI2016/050494
§ 371 (c)(1),
(2) Date: Jan. 5, 2018

(87) PCT Pub. No.: WO2017/005978
PCT Pub. Date: Jan. 12, 2017

(65) Prior Publication Data

US 2018/0213309 A1 Jul. 26, 2018

(30) Foreign Application Priority Data

Jul. 8, 2015 (GB) ..... 1511949.8

(51) Int. Cl.
*H04R 1/00* (2006.01)
*H04S 7/00* (2006.01)
(Continued)

(52) U.S. Cl.
CPC ..... *H04R 1/005* (2013.01); *H04R 1/406* (2013.01); *H04R 3/005* (2013.01); *H04R 5/027* (2013.01);
(Continued)

(58) Field of Classification Search
CPC combination set(s) only.
See application file for complete search history.

(56) References Cited

U.S. PATENT DOCUMENTS 9,319,782 B1 * 4/2016 Crump ..... H04R 3/02
2008/0130903 A1 * 6/2008 Ojanpera ..... G10L 19/008 381/2
(Continued)

FOREIGN PATENT DOCUMENTS

EP 2738762 A1 6/2014
WO WO 2010091736 A1 8/2010
(Continued)

OTHER PUBLICATIONS

K. Kowalczyk et al., "Parametric Spatial Sound Processing: A Flexible and Efficient Solution to Sound Scene Acquisition, Modification, and Reproduction", IEEE Signal Processing Magazine, vol. 32, No. 2, Mar. 2015, Abstract only, 1 pg.

*Primary Examiner* — Duc Nguyen
*Assistant Examiner* — Assad Mohammed
(74) *Attorney, Agent, or Firm* — Harrington & Smith

(57) ABSTRACT

Apparatus including: an audio capture application configured to determine separate microphones from a plurality of microphones and identify a sound source direction of at least one audio source within an audio scene by analyzing respective two or more audio signals from the separate microphones, wherein the audio capture application is further configured to adaptively select, from the plurality of microphones, two or more respective audio signals based on the determined direction and furthermore configured to select, from the two or more respective audio signals, a reference audio signal also based on the determined direction; and a signal generator configured to generate a mid signal representing the at least one audio source based on a combination of the selected two or more respective audio signals and with reference to the reference audio signal.

19 Claims, 5 Drawing Sheets

(51) Int. Cl.
*H04R 1/40* (2006.01)
*H04R 3/00* (2006.01)
*H04R 5/027* (2006.01)

(52) U.S. Cl.
CPC ..... *H04S 7/30* (2013.01); *H04R 2201/401* (2013.01); *H04S 2400/15* (2013.01); *H04S 2420/01* (2013.01)

(56) References Cited

U.S. PATENT DOCUMENTS

2009/0154739 A1* 6/2009 Zellner ..... H04R 1/1041 381/311
2009/0214058 A1* 8/2009 Christoph ..... H04S 3/02 381/119
2012/0121091 A1* 5/2012 Ojanpera ..... G10L 19/008 381/2
2012/0128174 A1* 5/2012 Tammi ..... H04S 1/002 381/92
2012/0224714 A1* 9/2012 Couse ..... H04R 1/406 381/92
2012/0263315 A1* 10/2012 Hiroe ..... G10L 21/0216 381/92
2013/0064374 A1* 3/2013 Lee ..... H04S 3/004 381/17
2013/0202114 A1* 8/2013 Tammi ..... H04R 1/406 381/1
2013/0315402 A1 11/2013 Visser et al. ..... 318/18
2015/0156578 A1* 6/2015 Alexandridis ..... H04R 3/005 381/92
2015/0199973 A1* 7/2015 Borsum ..... H04S 3/002 704/500

FOREIGN PATENT DOCUMENTS

WO WO 2011104146 A1 9/2011
WO WO 2014090277 A1 6/2014

* cited by examiner

SPATIAL AUDIO PROCESSING APPARATUS

FIELD

The present application relates to apparatus for the spatial processing of audio signals. The invention further relates to, but is not limited to, apparatus for spatial processing of audio signals to enable spatial reproduction of audio signals from mobile devices.

BACKGROUND

Spatial audio processing, wherein audio signals are processed based on directional information may be implemented within applications such as spatial sound reproduction. The aim of spatial sound reproduction is to reproduce the perception of spatial aspects of a sound field. These include the direction, the distance, and the size of the sound source, as well as properties of the surrounding physical space.

Microphone arrays can be used to capture these spatial aspects. However, often it is difficult to convert the captured signals into a form which preserves the ability to reproduce the event as if the listener was present when the signal was recorded. Particularly, the processed signals often lack spatial representation. In other words the listener may not sense the directions of the sound sources or the ambience around the listener in a way as would be experienced at the original event.

Parametric time-frequency processing methods have been suggested to attempt to overcome these problems. One such parametric processing method, called spatial audio capture (SPAC) is based on analysing the captured microphone signal in the time-frequency domain, and reproducing the processed audio using either loudspeakers or earphones. The perceived audio quality using this method has been found to be good, and the spatial aspects of captured audio signals can be faithfully reproduced.

SPAC was originally developed for using microphone signals from relatively compact arrays, such as mobile devices. However, there is demand to use SPAC with more versatile or geometrically variable arrays. For example a presence-capturing device may contain several microphones and acoustically shadowing objects. Conventional SPAC methods are not suitable for such systems.

SUMMARY

There is provided according to a first aspect an apparatus comprising: an audio capture/reproduction application configured to determine separate microphones from a plurality of microphones and identify a sound source direction of at least one audio source within an audio scene by analysing respective two or more audio signals from the separate microphones, wherein the audio capture/reproduction application is further configured to adaptively select, from the plurality of microphones, two or more respective audio signals based on the determined direction and furthermore configured to select, from the two or more respective audio signals, a reference audio signal also based on the determined direction; and a signal generator configured to generate a mid signal representing the at least one audio source based on a combination of the selected two or more respective audio signals and with reference to the reference audio signal.

The audio capture/reproduction apparatus may be an audio capture apparatus only. The audio capture/reproduction apparatus may be an audio reproduction apparatus only.

The audio capture/reproduction application may be further configured to: identify two or more microphones from the plurality of microphones based on the determined direction and a microphone orientation such that the two or microphones identified are the microphones closest to the at least one audio source; and select based on the identified two or more microphones the two or more respective audio signals.

The audio capture/reproduction application may be further configured to identify from the two or microphones identified which microphone is closest to the at least one audio source based on the determined direction and select the microphone closest to the at least one audio source respective audio signal as the reference audio signal.

The audio capture/reproduction application may be further configured to determine a coherence delay between the reference audio signal and others of the selected two or more respective audio signals, wherein the coherence delay is the delay value which maximises the coherence between the reference audio signal and another of the two or more respective audio signals.

The signal generator may be configured to: time align the others of the selected two or more respective audio signals with the reference audio signal based on the determined coherence delay; and combine the time aligned others of the selected two or more respective audio signals with the reference audio signal.

The signal generator may further be configured to generate a weighting value based on the difference between a microphone direction for the two or more respective audio signals and the determined direction, and apply the weighting value to the respective two or more audio signals prior to the signal combiner combining.

The signal generator may be configured to sum the time aligned others of the selected two or more respective audio signals with the reference audio signal The apparatus may further comprise a further signal generator configured to further select from the plurality of microphones, a further selection of two or more respective audio signals and generate from a combination of the further selection of two or more respective audio signals at least two side signals representing an audio scene ambience.

The further signal generator may be configured to select the further selection of two or more respective audio signals based on at least one of: an output type; and a distribution of the plurality of microphones.

The further signal generator may be configured to: determine an ambience coefficient associated with each of the further selection of two or more respective audio signals; apply the determined ambience coefficient to the further selection of two or more respective audio signals to generate a signal component for each of the at least two side signals; and decorrelate the signal component for each of the at least two side signals.

The further signal generator may be configured to: apply a pair of head related transfer function filters; and combine the filtered decorrelated signal components to generate the at least two side signals representing the audio scene ambience.

The further signal generator may be configured to generate filtered decorrelated signal components to generate a left and a right channel audio signal representing an audio scene ambience.

The ambience coefficient for an audio signal from the further selection of two or more respective audio signals may be based on a coherence value between the audio signal and the reference audio signal.

The ambience coefficient for an audio signal from the further selection of two or more respective audio signals may be based on a determined circular variance over time and/or frequency of a direction of arrival from the at least one audio source.

The ambience coefficient for an audio signal from the further selection of two or more respective audio signals may be based on both a coherence value between the audio signal and the reference audio signal and a determined circular variance over time and/or frequency of a direction of arrival from the at least one audio source.

The separate microphones may be positioned in a determined fixed configuration on the apparatus.

According to a second aspect there is provided an apparatus comprising: a sound source direction determiner configured to determine separate microphones from a plurality of microphones and identify a sound source direction of at least one audio source within an audio scene by analysing respective two or more audio signals from the separate microphones; a channel selector configured to adaptively select, from the plurality of microphones, two or more respective audio signals based on the determined direction and furthermore configured to select, from the two or more respective audio signals, a reference audio signal also based on the determined direction; and a signal generator configured to generate a mid signal representing the at least one audio source based on a combination of the selected two or more respective audio signals and with reference to the reference audio signal.

The channel selector may comprise: a channel determiner configured to identify two or more microphones from the plurality of microphones based on the determined direction and a microphone orientation such that the two or microphones identified are the microphones closest to the at least one audio source; and a channel signal selector configured to select based on the identified two or more microphones the two or more respective audio signals.

The channel determiner may be further configured to identify from the two or microphones identified which microphone is closest to the at least one audio source based on the determined direction and wherein the channel signal selector may be configured to select the microphone closest to the at least one audio source respective audio signal as the reference audio signal.

The apparatus may further comprise a coherence delay determiner configured to determine a coherence delay between the reference audio signal and others of the selected two or more respective audio signals, wherein the coherence delay may be the delay value which maximises the coherence between the reference audio signal and another of the two or more respective audio signals.

The signal generator may comprise: a signal aligner configured to time align the others of the selected two or more respective audio signals with the reference audio signal based on the determined coherence delay; and a signal combiner configured to combine the time aligned others of the selected two or more respective audio signals with the reference audio signal.

The apparatus may further comprise a direction dependent weight determiner configured to generate a weighting value based on the difference between a microphone direction for the two or more respective audio signals and the determined direction, wherein the signal generator may further comprise a signal processor configured to apply the weighting value to the respective two or more audio signals prior to the signal combiner combining.

The signal combiner may sum the time aligned others of the selected two or more respective audio signals with the reference audio signal.

The apparatus may further comprise a further signal generator configured to further select from the plurality of microphones, a further selection of two or more respective audio signals and generate from a combination of the further selection of two or more respective audio signals at least two side signals representing an audio scene ambience.

The further signal generator may be configured to select the further selection of two or more respective audio signals based on at least one of: an output type; and a distribution of the plurality of microphones.

The further signal generator may comprise: an ambience determiner configured to determine an ambience coefficient associated with each of the further selection of two or more respective audio signals; a side signal component generator configured to apply the determined ambience coefficient to the further selection of two or more respective audio signals to generate a signal component for each of the at least two side signals; and a filter configured to decorrelate the signal component for each of the at least two side signals.

The further signal generator may comprise: a pair of head related transfer function filters configured to receive each decorrelated signal component; and a side signal channels generator configured to combine the filtered decorrelated signal components to generate the at least two side signals representing the audio scene ambience.

The pair of head related transfer function filters may be configured to generate filtered decorrelated signal components to generate a left and a right channel audio signal representing an audio scene ambience.

The ambience coefficient for an audio signal from the further selection of two or more respective audio signals may be based on a coherence value between the audio signal and the reference audio signal.

The ambience coefficient for an audio signal from the further selection of two or more respective audio signals may be based on a determined circular variance over time and/or frequency of a direction of arrival from the at least one audio source.

The ambience coefficient for an audio signal from the further selection of two or more respective audio signals may be based on both a coherence value between the audio signal and the reference audio signal and a determined circular variance over time and/or frequency of a direction of arrival from the at least one audio source.

The separate microphones may be positioned in a determined fixed configuration on the apparatus.

According to a third aspect there is provided a method comprising: determining separate microphones from a plurality of microphones; identifying a sound source direction of at least one audio source within an audio scene by analysing respective two or more audio signals from the separate microphones; adaptively selecting, from the plurality of microphones, two or more respective audio signals based on the determined direction; selecting, from the two or more respective audio signals, a reference audio signal also based on the determined direction; and generating a mid signal representing the at least one audio source based on a combination of the selected two or more respective audio signals and with reference to the reference audio signal.

Adaptively selecting, from the plurality of microphones, two or more respective audio signals based on the determined direction may comprise: identifying two or more microphones from the plurality of microphones based on the determined direction and a microphone orientation such that the two or microphones identified are the microphones closest to the at least one audio source; and selecting based on the identified two or more microphones the two or more respective audio signals.

Adaptively selecting, from the plurality of microphones, two or more respective audio signals based on the determined direction may comprise identifying from the two or microphones identified which microphone is closest to the at least one audio source based on the determined direction, and selecting, from the two or more respective audio signals, a reference audio signal may comprise selecting an audio signal associated with the microphone closest to the at least one audio source as the reference audio signal.

The method may further comprise determining a coherence delay between the reference audio signal and others of the selected two or more respective audio signals, wherein the coherence delay is the delay value which maximises the coherence between the reference audio signal and another of the two or more respective audio signals.

Generating a mid signal representing the at least one audio source based on a combination of the selected two or more respective audio signals and with reference to the reference audio signal may comprise: time aligning the others of the selected two or more respective audio signals with the reference audio signal based on the determined coherence delay; and combining the time aligned others of the selected two or more respective audio signals with the reference audio signal.

The method may further comprise generating a weighting value based on the difference between a microphone direction for the two or more respective audio signals and the determined direction, wherein generating a mid signal may further comprise applying the weighting value to the respective two or more audio signals prior to the signal combiner combining.

Combining the time aligned others of the selected two or more respective audio signals with the reference audio signal may comprise summing the time aligned others of the selected two or more respective audio signals with the reference audio signal.

The method may further comprise: further selecting from the plurality of microphones, a further selection of two or more respective audio signals; and generating from a combination of the further selection of two or more respective audio signals at least two side signals representing an audio scene ambience.

Selecting from the plurality of microphones, a further selection of two or more respective audio signals may comprise selecting the further selection of two or more respective audio signals based on at least one of: an output type; and a distribution of the plurality of microphones.

The method may comprise determining an ambience coefficient associated with each of the further selection of two or more respective audio signals; applying the determined ambience coefficient to the further selection of two or more respective audio signals to generate a signal component for each of the at least two side signals; and decorrelating the signal component for each of the at least two side signals.

The method may further comprise: applying a pair of head related transfer function filters to each decorrelated signal component; and combining the filtered decorrelated signal components to generate the at least two side signals representing the audio scene ambience.

Applying the pair of head related transfer function filters may comprise generating a left and a right channel audio signal representing an audio scene ambience.

Determining an ambience coefficient associated with each of the further selection of two or more respective audio signals may be based on a coherence value between the audio signal and the reference audio signal.

Determining an ambience coefficient associated with each of the further selection of two or more respective audio signals may be based on a determined circular variance over time and/or frequency of a direction of arrival from the at least one audio source.

Determining an ambience coefficient associated with each of the further selection of two or more respective audio signals may be based on both a coherence value between the audio signal and the reference audio signal and a determined circular variance over time and/or frequency of a direction of arrival from the at least one audio source.

According to a fourth aspect there is provided an apparatus comprising: means for determining separate microphones from a plurality of microphones; means for identifying a sound source direction of at least one audio source within an audio scene by analysing respective two or more audio signals from the separate microphones; means for adaptively selecting, from the plurality of microphones, two or more respective audio signals based on the determined direction; means for selecting, from the two or more respective audio signals, a reference audio signal also based on the determined direction; and means for generating a mid signal representing the at least one audio source based on a combination of the selected two or more respective audio signals and with reference to the reference audio signal.

The means for adaptively selecting, from the plurality of microphones, two or more respective audio signals based on the determined direction may comprise: means for identifying two or more microphones from the plurality of microphones based on the determined direction and a microphone orientation such that the two or microphones identified are the microphones closest to the at least one audio source; and means for selecting based on the identified two or more microphones the two or more respective audio signals.

The means for adaptively selecting, from the plurality of microphones, two or more respective audio signals based on the determined direction may comprise: means for identifying from the two or microphones identified which microphone is closest to the at least one audio source based on the determined direction, and means for selecting, from the two or more respective audio signals, a reference audio signal may comprise means for selecting an audio signal associated with the microphone closest to the at least one audio source as the reference audio signal.

The apparatus may further comprise means for determining a coherence delay between the reference audio signal and others of the selected two or more respective audio signals, wherein the coherence delay is the delay value which maximises the coherence between the reference audio signal and another of the two or more respective audio signals.

The means for generating a mid signal representing the at least one audio source based on a combination of the selected two or more respective audio signals and with reference to the reference audio signal may comprise: time aligning the others of the selected two or more respective audio signals with the reference audio signal based on the determined coherence delay; and combining the time aligned others of the selected two or more respective audio signals with the reference audio signal. The apparatus may further comprise means for generating a weighting value based on the difference between a microphone direction for the two or more respective audio signals and the determined direction, wherein the means for generating a mid signal may further comprise means for applying the weighting value to the respective two or more audio signals prior to the signal combiner combining.

The means for combining the time aligned others of the selected two or more respective audio signals with the reference audio signal may comprise means for summing the time aligned others of the selected two or more respective audio signals with the reference audio signal The apparatus may further comprise: means for further selecting from the plurality of microphones, a further selection of two or more respective audio signals; and means for generating from a combination of the further selection of two or more respective audio signals at least two side signals representing an audio scene ambience.

The means for selecting from the plurality of microphones, a further selection of two or more respective audio signals may comprise means for selecting the further selection of two or more respective audio signals based on at least one of: an output type; and a distribution of the plurality of microphones.

The apparatus may comprise means for determining an ambience coefficient associated with each of the further selection of two or more respective audio signals; means for applying the determined ambience coefficient to the further selection of two or more respective audio signals to generate a signal component for each of the at least two side signals; and means for decorrelating the signal component for each of the at least two side signals.

The apparatus may further comprise: means for applying a pair of head related transfer function filters to each decorrelated signal component; and means for combining the filtered decorrelated signal components to generate the at least two side signals representing the audio scene ambience.

The means for applying the pair of head related transfer function filters may comprise means for generating a left and a right channel audio signal representing an audio scene ambience.

The means for determining an ambience coefficient associated with each of the further selection of two or more respective audio signals may be based on a coherence value between the audio signal and the reference audio signal.

The means for determining an ambience coefficient associated with each of the further selection of two or more respective audio signals may be based on a determined circular variance over time and/or frequency of a direction of arrival from the at least one audio source.

The means for determining an ambience coefficient associated with each of the further selection of two or more respective audio signals may be based on both a coherence value between the audio signal and the reference audio signal and a determined circular variance over time and/or frequency of a direction of arrival from the at least one audio source.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
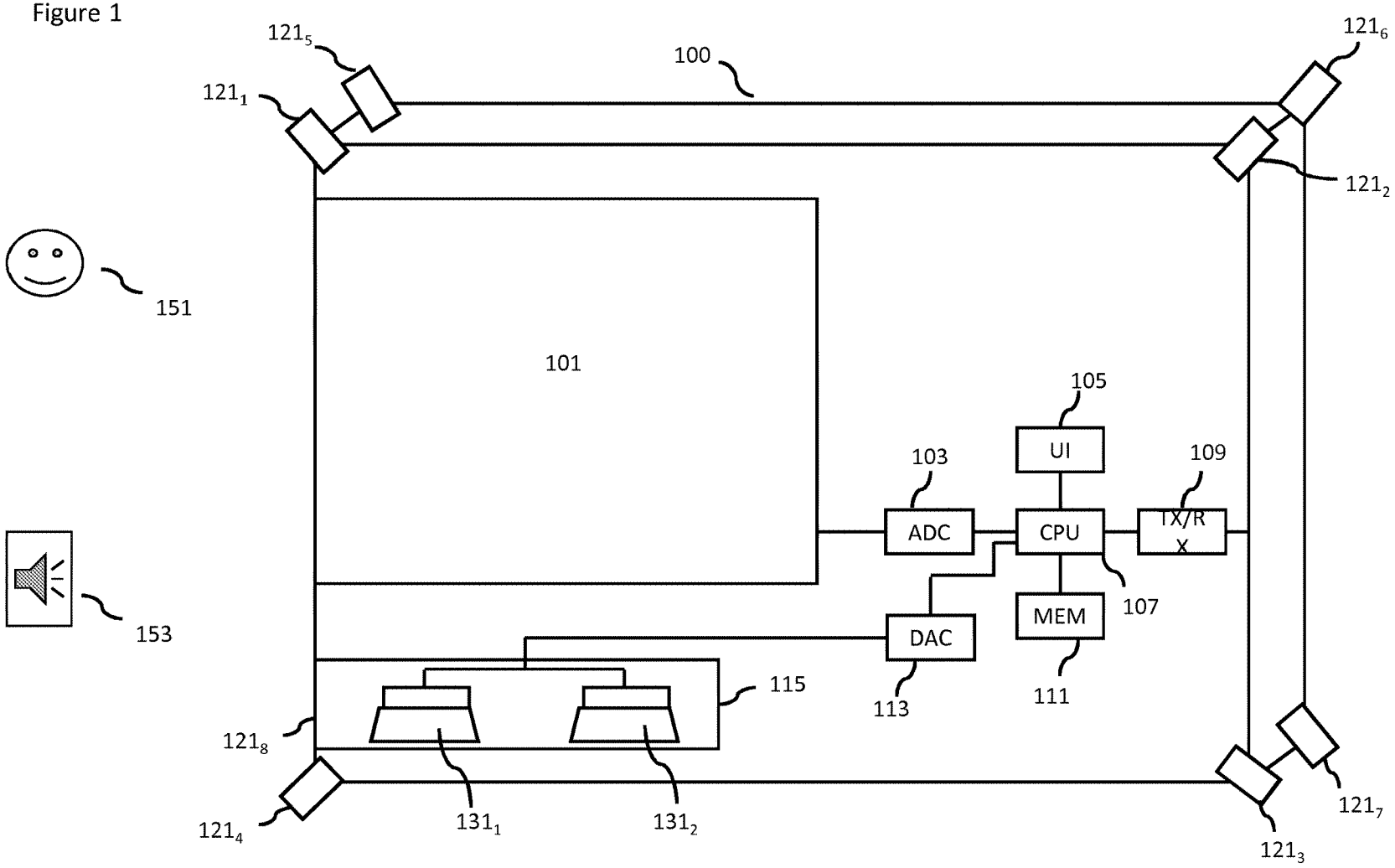
FIG. 1 shows schematically an audio capture apparatus suitable for implementing spatial audio signal processing according to some embodiments.

The following describes in further detail suitable apparatus and possible mechanisms for the provision of effective spatial signal processing. In the following examples, audio signals and audio capture signals are described. However it would be appreciated that in some embodiments the audio signal/audio capture is a part of an audio-video system.

Spatial audio capture (SPAC) methods are based on dividing the captured microphone signals into mid and side components, and storing and/or processing the components separately. The creation of these components using conventional SPAC methods when using microphone arrays with several microphones and acoustically shadowing objects (such as the body of the capture device) is not directly supported. Thus modifications to the SPAC method are required in order to permit effective spatial signal processing.

For example conventional SPAC processing uses two pre-determined microphones for creating the mid signal. Using pre-determined microphones may be problematic where there is an acoustically shadowing object located between the microphones such as the body of the capturing device. The shadowing effect depends on the direction of arrival (DOA) of the audio source and the frequency. As a result, the timbre of the captured audio would depend on the DOA. For example the sounds coming from behind the capturing device may sound dull compared to the sounds coming from the front of the capturing device.

The acoustical shadowing effect may be exploited with respect to embodiments discussed herein to improve the audio quality by offering improved spatial source separation for sounds originating from different directions.

Furthermore conventional SPAC processing also uses two pre-determined microphones for creating the side signal. The presence of a shadowing object may be problematic when creating the side signal as the resulting spectrum of the side signal is also dependent on the DOA. In the embodiments described herein this problem is addressed by employing multiple microphones around the acoustically shadowing object.

Moreover, where multiple microphones are employed around the acoustically shadowing object, their outputs are mutually incoherent. This natural incoherence of the microphone signals is a highly desired property in spatial-audio processing and employed in embodiments as described herein. This is further exploited in the embodiments described herein by the generation of multiple side signals. In such embodiments a directionality aspect of the side-signal may be exploited. This is because, in practice, the side signal contains direct sound components that are not expressed in the conventional SPAC processing for the side signal.

The concept as disclosed herein in the embodiments shown thus modify and extend conventional spatial audio capture (SPAC) methodology to microphone arrays containing several microphones and acoustically shadowing objects.

The concept may be broken into aspects such as: creating the mid signal using adaptively selected subsets of available microphones; and creating multiple side signals using multiple microphones. In such embodiments these aspects improve the resulting audio quality with the aforementioned microphone arrays.

With respect to the first aspect the embodiments described in further detail hereafter select a subset of microphones for creating the mid signal adaptively based on an estimated direction of arrival (DOA). Furthermore the microphone 'nearest' or 'nearer' to the estimated DOA is then in some embodiments selected as a 'reference' microphone. The other selected microphone audio signals can then be time aligned with the audio signal from the 'reference' audio signal. The time-aligned microphone signals may then be summed to form the mid signal. In some embodiments the selected microphone audio signals can be weighted based on the estimated DOA to avoid discontinuities when changing from one microphone subset to another.

With respect to the second aspect the embodiments described hereafter may create the side signals by using two or more microphones for creating the multiple side signals. To generate each side signal the microphone audio signals are weighted with an adaptive time-frequency-dependent gain. Furthermore in some embodiments these weighted audio signals are convolved with a predetermined decorrelator or filter configure to decorrelate the audio signals. The generation of the multiple audio signals may in some embodiments further comprise passing the audio signal through a suitable presentation or reproduction related filter. For example the audio signals may be passed through a head related transfer function (HRTF) filter where earphones or earpiece reproduction is expected or a multi-channel loudspeaker transfer function filter where loudspeaker presentation is expected.

In some embodiments the presentation or reproduction filter is optional and the audio signals directly reproduced with loudspeakers.

The result of such embodiments as described in further detail hereafter is an encoding of the audio scene enabling the later reproduction or presentation producing a perception of an enveloping sound field with some directionality, due to the incoherence and the acoustical shadowing of the microphones.

In the following examples the signal generator configured to generate the mid signal is separate from the signal generator configured to generate the side signals. However in some embodiments there may be a single generator or module configured to generate the mid signal and to generate the side signals.

Furthermore in some embodiments the mid signal generation may be implemented for example by an audio capture/reproduction application configured to determine separate microphones from a plurality of microphones and identify a sound source direction of at least one audio source within an audio scene by analysing respective two or more audio signals from the separate microphones. The audio capture/reproduction application may be further configured to adaptively select, from the plurality of microphones, two or more respective audio signals based on the determined direction. Furthermore the audio capture/reproduction application may be configured to select, from the two or more respective audio signals, a reference audio signal also based on the determined direction. The implementation may then comprise a (mid) signal generator configured to generate a mid signal representing the at least one audio source based on a combination of the selected two or more respective audio signals and with reference to the reference audio signal.

In the application detailed herein the audio capture/reproduction application should be interpreted as being an application which may have both audio capture and audio reproduction capacity. Furthermore in some embodiments the audio capture/reproduction application may be interpreted as being an application which has audio capture capacity only. In other words there is no capability of reproducing the captured audio signals. In some embodiments the audio capture/reproduction application may be interpreted as being an application which has audio reproduction capacity only, or is only configured to retrieve previously captured or recorded audio signals from the microphone array for encoding or audio processing output purposes.

According to another view the embodiments may be implemented by an apparatus comprising a plurality of microphones for an enhanced audio capture. The apparatus may be configured to determine separate microphones from the plurality of microphones and identify a sound source direction of at least one audio source within an audio scene by analysing respective two or more audio signals from the separate microphones. The apparatus may further be configured to adaptively select, from the plurality of microphones, two or more respective audio signals based on the determined direction. Furthermore the apparatus may be configured to select, from the two or more respective audio signals, a reference audio signal also based on the determined direction. The apparatus may thus be configured to generate a mid signal representing the at least one audio source based on a combination of the selected two or more respective audio signals and with reference to the reference audio signal.

With respect to FIG. 1 an example audio capture apparatus suitable for implementing spatial audio signal processing according to some embodiments is shown.

The audio capture apparatus 100 may comprise a microphone array 101. The microphone array 101 may comprise a plurality (for example a number N) of microphones. The example shown in FIG. 1 shows the microphone array 101 comprising 8 microphones $\mathbf{121}_1$ to $\mathbf{121}_8$ organised in a hexahedron configuration. In some embodiments the microphones may be organised such that they are located at the corners of the audio capture device casing such that the user of the audio capture apparatus 100 may hold the apparatus without covering or blocking any of the microphones. However it is understood that there may be employed any suitable configuration of microphones and any suitable number of microphones.

The microphones 121 are shown and described herein may be transducers configured to convert acoustic waves into suitable electrical audio signals. In some embodiments the microphones 121 can be solid state microphones. In other words the microphones 121 may be capable of capturing audio signals and outputting a suitable digital format signal. In some other embodiments the microphones or array of microphones 121 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones 121 can in some embodiments output the audio captured signal to an analogue-to-digital converter (ADC) 103.

The audio capture apparatus 100 may further comprise an analogue-to-digital converter 103. The analogue-to-digital converter 103 may be configured to receive the audio signals from each of the microphones 121 in the microphone array 101 and convert them into a format suitable for processing. In some embodiments where the microphones 121 are integrated microphones the analogue-to-digital converter is not required. The analogue-to-digital converter 103 can be any suitable analogue-to-digital conversion or processing means. The analogue-to-digital converter 103 may be configured to output the digital representations of the audio signals to a processor 107 or to a memory 111.

In some embodiments the audio capture apparatus 100 comprises at least one processor or central processing unit 107. The processor 107 can be configured to execute various program codes. The implemented program codes can comprise, for example, spatial processing, mid signal generation, side signal generation, time-to-frequency domain audio signal conversion, frequency-to-time domain audio signal conversions and other code routines.

In some embodiments the audio capture apparatus comprises a memory 111. In some embodiments the at least one processor 107 is coupled to the memory 111. The memory 111 can be any suitable storage means. In some embodiments the memory 111 comprises a program code section for storing program codes implementable upon the processor 107. Furthermore in some embodiments the memory 111 can further comprise a stored data section for storing data, for example data that has been processed or to be processed in accordance with the embodiments as described herein. The implemented program code stored within the program code section and the data stored within the stored data section can be retrieved by the processor 107 whenever needed via the memory-processor coupling.

In some embodiments the audio capture apparatus comprises a user interface 105. The user interface 105 can be coupled in some embodiments to the processor 107. In some embodiments the processor 107 can control the operation of the user interface 105 and receive inputs from the user interface 105. In some embodiments the user interface 105 can enable a user to input commands to the audio capture apparatus 100, for example via a keypad. In some embodiments the user interface 105 can enable the user to obtain information from the apparatus 100. For example the user interface 105 may comprise a display configured to display information from the apparatus 100 to the user. The user interface 105 can in some embodiments comprise a touch screen or touch interface capable of both enabling information to be entered to the apparatus 100 and further displaying information to the user of the apparatus 100.

In some implements the audio capture apparatus 100 comprises a transceiver 109. The transceiver 109 in such embodiments can be coupled to the processor 107 and configured to enable a communication with other apparatus or electronic devices, for example via a wireless communications network. The transceiver 109 or any suitable transceiver or transmitter and/or receiver means can in some embodiments be configured to communicate with other electronic devices or apparatus via a wire or wired coupling.

The transceiver 109 can communicate with further apparatus by any suitable known communications protocol. For example in some embodiments the transceiver 109 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the audio capture apparatus 100 comprises a digital-to-analogue converter 113. The digital-to-analogue converter 113 may be coupled to the processor 107 and/or memory 111 and be configured to convert digital representations of audio signals (such as from the processor 107) to a suitable analogue format suitable for presentation via an audio subsystem output. The digital-to-analogue converter (DAC) 113 or signal processing means can in some embodiments be any suitable DAC technology.

Furthermore the audio subsystem can comprise in some embodiments an audio subsystem output 115. An example as shown in FIG. 1 is a pair of speakers $\mathbf{131}_1$ and $\mathbf{131}_2$. The speakers 131 can in some embodiments be configured to receive the output from the digital-to-analogue converter 113 and present the analogue audio signal to the user. In some embodiments the speakers 131 can be representative of a headset, for example a set of earphones, or cordless earphones.

Furthermore the audio capture apparatus 100 is shown operating within an environment or audio scene wherein there are multiple audio sources present. In the example shown in FIG. 1 and described herein the environment comprises a first audio source 151, a vocal source such as a person talking at a first location. Furthermore the environment shown in FIG. 1 comprises a second audio source 153, an instrumental source such as a trumpet playing, at a second location. The first and second locations for the first and second audio sources 151 and 153 respectively may be different. Furthermore in some embodiments the first and second audio sources may generate audio signals with different spectral characteristics.

Although the audio capture apparatus 100 is shown having both audio capture and audio presentation components, it would be understood that in some embodiments the apparatus 100 can comprise just the audio capture elements such that only the microphone (for audio capture) are present. Similarly in the following examples the audio capture apparatus 100 is described being suitable to performing the spatial audio signal processing described hereafter. In some embodiments the audio capture components and the spatial signal processing components may be separate. In other words the audio signals may be captured by a first apparatus comprising the microphone array and a suitable transmitter. The audio signals may then be received and processed in a manner as described herein in a second apparatus comprising a receiver and processor and memory.

As described herein the apparatus is configured to generate at least one mid signal configured to represent the audio source information and at least two side signals configured to represent the ambient audio information. The uses of the mid and side signals, for example in such applications as source spatial panning, source spatial focussing and source emphasis, is known in the art and not described in further detail. Thus the following description focuses on the generation of the mid and side signals using the microphone arrays.

Figure 2:
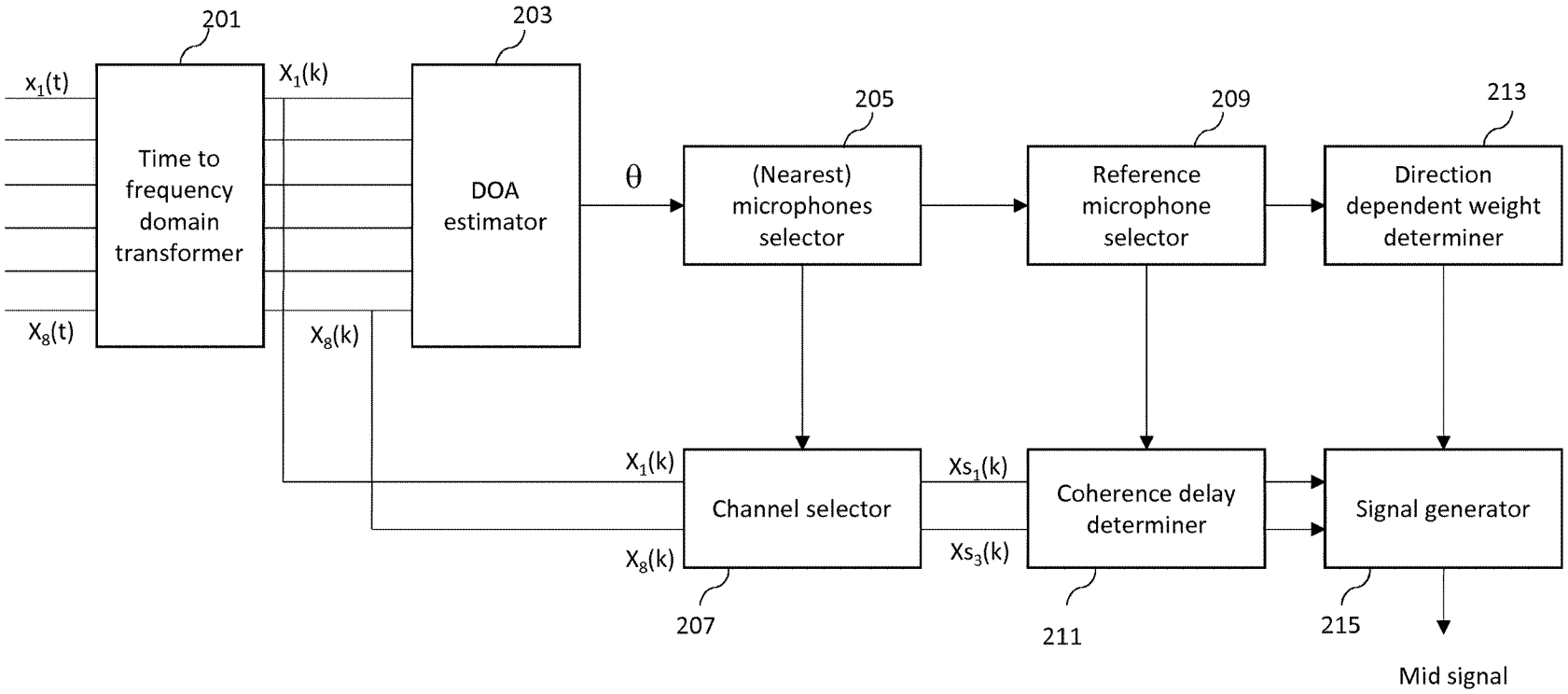
FIG. 2 shows schematically a mid signal generator for a spatial audio signal processor according to some embodiments.

With respect to FIG. 2 an example mid signal generator is shown. The mid signal generator as a collection of components configured to spatially process the microphone audio signals and generate the mid signal. In some embodiments the mid signal generator is implemented as software code which may be executed on the processor. However in some embodiments the mid signal generator is at least partially implemented as separate hardware separate to or implemented on the processor. For example the mid signal generator may comprise components which are implemented on the processor in the form of a system on chip (SoC) architecture. In other words the mid signal generator may be implemented in hardware, software or a combination of hardware and software.

The mid signal generator as shown in FIG. 2 is an exemplary implementation of the mid signal generator. However it is understood that the mid signal generator may be implemented within different suitable elements. For example in some embodiments the mid signal generator may be implemented for example by an audio capture/reproduction application configured to determine separate microphones from a plurality of microphones and identify a sound source direction of at least one audio source within an audio scene by analysing respective two or more audio signals from the separate microphones. The audio capture/reproduction application may be further configured to adaptively select, from the plurality of microphones, two or more respective audio signals based on the determined direction. Furthermore the audio capture/reproduction application may be configured to select, from the two or more respective audio signals, a reference audio signal also based on the determined direction. The implementation may then comprise a (mid) signal generator configured to generate a mid signal representing the at least one audio source based on a combination of the selected two or more respective audio signals and with reference to the reference audio signal.

The mid signal generator in some embodiments is configured to receive the microphone signals in a time domain format. In such embodiments the microphone audio signals may be represented in the time domain digital representation as $x_1(t)$ representing a first microphone audio signal to $x_8(t)$ representing the eighth microphone audio signal at time t. More generally the n'th microphone audio signal may be represented by $x_n(t)$.

In some embodiments the mid signal generator comprises a time-to-frequency domain transformer 201. The time-to-frequency domain transformer 201 may be configured to generate frequency domain representations of the audio signals from each microphone. The time-to-frequency domain transformer 201 or suitable transformer means can be configured to perform any suitable time-to-frequency domain transformation on the audio data. In some embodiments the time-to-frequency domain transformer can be a discrete fourier transformer (DFT). However the transformer 201 can be any suitable transformer such as a discrete cosine transformer (DCT), a fast fourier transformer (FFT) or a quadrature mirror filter (QMF).

In some embodiments the mid signal generator may furthermore pre-process the audio signals prior to the time-to-frequency domain transformer 201 by framing and windowing the audio signals. In other words the time-to-frequency transformer 201 may be configured to receive the audio signals from the microphones and divide the digital format signals into frames or groups of audio signals. In some embodiments the time-to-frequency domain transformer 201 can furthermore be configured to window the audio signals using any suitable windowing function. The time-to-frequency domain transformer 201 can be configured to generate frames of audio signal data for each microphone input wherein the length of each frame and a degree of overlap of each frame can be any suitable value. For example in some embodiments each audio frame is 20 milliseconds long and has an overlap of 10 milliseconds between frames.

The output of the time-to-frequency domain transformer 201 may thus be generally be represented as $X_n(k)$ where n identifies the microphone channel and k identifies the frequency band or sub-band for a specific time frame.

The time-to-frequency domain transformer 201 can be configured to output a frequency domain signal for each microphone input to a direction of arrival (DOA) estimator 203 and to a channel selector 207.

In some embodiments the mid signal generator comprises a direction of arrival (DOA) estimator 203. The DOA estimator 203 may be configured to receive the frequency domain audio signals from each of the microphones and generate suitable direction of arrival estimates for the audio scene (and in some embodiments for each of the audio sources.). The direction of arrival estimates can be passed to a (nearest) microphones selector 205.

The DOA estimator 203 may employ any suitable direction of arrival determination for any dominant audio source. For example a DOA estimator or suitable DOA estimation means may select a frequency sub-band and the associated frequency domain signals for each microphone of the sub-band.

The DOA estimator 203 can then be configured to perform directional analysis on the microphone audio signals in the sub-band. The DOA estimator 203 can in some embodiments be configured to perform a cross correlation between the microphone channel sub-band frequency domain signals.

In the DOA estimator 203 the delay value of the cross correlation is found which maximises the cross correlation of the frequency domain sub-band signals between two microphone audio signals. This delay can in some embodiments be used to estimate the angle or represent the angle (relative to a line between the microphones) from the dominant audio signal source for the sub-band. This angle can be defined as a. It would be understood that whilst the pair or two microphones channels can provide a first angle, an improved directional estimate can be produced by using more than two microphone channels and preferably by microphones on two or more axes.

In some embodiments the DOA estimator 203 may be configured to determine a direction of arrival estimate for more than one frequency sub-band to determine whether the environment comprises more than one audio source.

The examples herein describe direction analysis using frequency domain correlation values. However it is understood that the DOA estimator 203 can perform directional analysis using any suitable method. For example in some embodiments the DOA estimator may be configured to output specific azimuth-elevation values rather than maximum correlation delay values. Furthermore in some embodiments the spatial analysis can be performed in the time domain.

In some embodiments this DOA estimator may be configured to perform direction analysis starting with a pair of microphone channel audio signals and can therefore be defined as receiving the audio sub-band data;

$$X_k^b(n)=X_k(n_b+n),\ n=0,\ldots,n_{b+1}-n_b-1,\quad b=0,\ldots,B-1$$

where $n_b$ is the first index of bth subband. In some embodiments for every subband the directional analysis as described herein as follows. First the direction is estimated with two channels. The direction analyser finds delay $\tau_b$ that maximizes the correlation between the two channels for subband b. DFT domain representation of e.g. $X_k^b(n)$ can be shifted $\tau_b$ time domain samples using $$X_{k,\tau_b}^b(n) = X_k^b(n)e^{-j\frac{2\pi n\tau_b}{N}}.$$

The optimal delay in some embodiments can be obtained from $$\max_{\tau_b} \mathrm{Re}\left(\sum_{n=0}^{n_{b+1}-n_b-1} (X_{2,\tau_b}^b(n)^* X_3^b(n))\right),\ \tau_b \in [-D_{tot}, D_{tot}]$$

where Re indicates the real part of the result and * denotes a complex conjugate. $X_{2,\tau_b}^b$ and $X_3^b$ are considered vectors with length of $n_{b+1}-n_b$ samples. The direction analyser can in some embodiments implement a resolution of one time domain sample for the search of the delay.

In some embodiments the object detector and separator can be configured to generate a 'summed' signal. The 'summed' signal can be mathematically defined as.

$$X_{sum}^b = \begin{cases} (X_{2,\tau_b}^b + X_3^b)/2 & \tau_b \le 0 \\ (X_2^b + X_{3,-\tau_b}^b)/2 & \tau_b > 0 \end{cases}$$

In other words the DOA estimator 203 is configured to generate a 'summed' signal where the content of the channel in which an event occurs first is added with no modification, whereas the channel in which the event occurs later is shifted to obtain best match to the first channel.

It would be understood that the delay or shift $\tau_b$ indicates how much closer the sound source is to one microphone (or channel) than another microphone (or channel). The direction analyser can be configured to determine actual difference in distance as $$\Delta_{23} = \frac{v\tau_b}{F_s}$$

where Fs is the sampling rate of the signal and v is the speed of the signal in air (or in water if we are making underwater recordings).

The angle of the arriving sound is determined by the direction analyser as, $$\dot{\alpha}_b = \pm\cos^{-1}\left(\frac{\Delta_{23}^2 + 2b\Delta_{23} - d^2}{2db}\right)$$

where d is the distance between the pair of microphones/channel separation and b is the estimated distance between sound sources and nearest microphone. In some embodiments the direction analyser can be configured to set the value of b to a fixed value. For example b=2 meters has been found to provide stable results.

It would be understood that the determination described herein provides two alternatives for the direction of the arriving sound as the exact direction cannot be determined with only two microphones/channels.

In some embodiments the DOA estimator 203 is configured to use audio signals from further microphone channels to define which of the signs in the determination is correct. The distances between the third channel or microphone and the two estimated sound sources are:

$$\delta_b^+=\sqrt{(h+b\sin(\dot{\alpha}_b))^2+(d/2+b\cos(\dot{\alpha}_b))^2}$$

$$\delta_b^-=\sqrt{(h-b\sin(\dot{\alpha}_b))^2+(d/2+b\cos(\dot{\alpha}_b))^2}$$

where h is the height of an equilateral triangle (where the channels or microphones determine a triangle), i.e.

$$h = \frac{\sqrt{3}}{2}d.$$

The distances in the above determination can be considered to be equal to delays (in samples) of;

$$\tau_b^+ = \frac{\delta^+ - b}{v}F_s$$

$$\tau_b^- = \frac{\delta^- - b}{v}F_s$$

Out of these two delays the DOA estimator 203 in some embodiments is configured to select the one which provides better correlation with the sum signal. The correlations can for example be represented as $$c_b^+ = \mathrm{Re}\left(\sum_{n=0}^{n_{b+1}-n_b-1} (X_{sum,\tau_b^+}^b(n)^* X_1^b(n))\right)$$

$$c_b^- = \mathrm{Re}\left(\sum_{n=0}^{n_{b+1}-n_b-1} (X_{sum,\tau_b^-}^b(n)^* X_1^b(n))\right)$$

The object detector and separator can then in some embodiments then determine the direction of the dominant sound source for subband b as:

$$\alpha_b = \begin{cases} \dot{\alpha}_b & c_b^+ \ge c_b^- \\ -\dot{\alpha}_b & c_b^+ < c_b^- \end{cases}.$$

The DOA estimator 203 is shown generating a direction of arrival estimate $\alpha_b$ (relative to the microphones) for the dominant audio source in a sub-band b using three microphone channel audio signals. In some embodiments these determinations may be performed for other 'triangle' microphone channel audio signals to determine at least one audio source DOA estimate θ where θ is a vector defining the direction of arrival $\theta=[\theta_x\ \theta y\ \theta z]$ relative to a defined suitable co-ordinate reference. Furthermore it is understood that the DOA estimation shown herein is an example DOA estimation only and that the DOA may be determined using any suitable method.

In some embodiments the mid signal generator comprises a (nearest) microphones selector 205. In the example shown herein the selection is a sub-set of the microphones chosen because they are determined to be the nearest relative to the direction of arrival of the sound source. The nearest microphones selector 205 may be configured to receive the output θ of the direction of arrival (DOA) estimator 203. The nearest microphones selector 205 may be configured to determine the microphones nearest the audio source based on the estimate θ from the DOA estimator 203 and information from the configuration of the microphones on the apparatus. In some embodiments the nearest 'triangle' of microphones are determined or selected based on a predefinition mapping of the microphones and the DOA estimation.

An example of method of selecting the microphones nearest the audio source can be found within V. Pulkki, "Virtual source positioning using vector base amplitude panning," J. Audio Eng. Soc., vol. 45, pp. 456-466, June 1997.

The selected (nearest) microphone channels (which may be represented by suitable microphone channel indices or indicators) can be passed to a channel selector 207.

Furthermore the selected nearest microphone channels and the direction of arrival value can be passed to a reference microphone selector 209.

In some embodiments of the mid signal generator comprises a reference microphone selector 209. The reference microphone selector 209 may be configured to receive the direction of arrival values and furthermore the selected (nearest) microphones indicators from the (nearest) microphone selector 205. The reference microphone selector 209 may then be configured to determine a reference microphone channel. In some embodiments the reference microphone channel is the nearest microphone compared to the direction of arrival. The nearest microphone can be found for example using the following equation $$c_i=\theta_x M_{x,i}+\theta_y M_{y,i}+\theta_z M_{z,i}$$

where $\theta=[\theta_x\ \theta_y\ \theta_z]$ is the DOA vector and $Mi=[M_{x,i}\ M_{y,i}\ M_{z,i}]$ is the direction vector of each microphone in the grid. The microphone yielding the largest $c_i$ is the closest microphone. This microphone is set as the reference microphone and the index representing the microphone is passed to the coherence delay determiner 211. In some embodiments the reference microphone selector 209 may be configured to select a microphone other than the 'nearest' microphone. The reference microphone selector 209 may be configured to select a second 'nearest' microphone, third 'nearest' microphone etc. In some circumstances the reference microphone selector 209 may be configured to receive other inputs and select a microphone channel based on these further inputs. For example a microphone fault indicator input may be received to indicate that the 'nearest' microphone is currently faulty, blocked (by the user or otherwise) or suffers from some problem and thus the reference microphone selector 209 may be configured to select the 'nearest' microphone with no such determined fault.

In some embodiments the mid signal generator comprises a channel selector 207. The channel selector 207 is configured to receive the frequency domain microphone channel audio signals and select or filter the microphone channel audio signals which match the selected nearest microphones indicated by the (nearest) microphone selector 205. These selected microphone channel audio signals can then be passed to a coherence delay determiner 211.

In some embodiments of the mid signal generator comprises a coherence delay determiner 211. The coherence delay determiner 211 is configured to receive the selected reference microphone index or indicator from the reference microphone selector 209 and furthermore receive the selected microphone channel audio signals from the channel selector 207. The coherence delay determiner 211 may then be configured to determine the delays which maximise the coherence between the reference microphone channel audio signal and at the other microphone signals.

For example where the channel selector selects three microphone channel audio signals the coherence delay determiner 211 may be configured to determine a first delay between the reference microphone audio signal and the second selected microphone audio signal and determine a second delay between the reference microphone audio signal and the third selected microphone audio signal.

The coherence delay between a microphone audio signal $X_2$ and the reference microphone $X_3$ in some embodiments can be obtained from $$\max_{\tau_b} \mathrm{Re}\left(\sum_{n=0}^{n_{b+1}-n_b-1} (X^b_{2,\tau_b}(n)^* X^b_3(n))\right),\ \tau_b \in [-D_{tot}, D_{tot}]$$

where Re indicates the real part of the result and * denotes a complex conjugate. $X_{2,\tau_b}{}^b$ and $X_3{}^b$ are considered vectors with length of $n_{b+1}-n_b$ samples.

The coherence delay determiner 211 may then output the determined coherence delays, for example the first and second coherence delays to the signal generator 215.

The mid signal generator may further comprise a direction dependent weight determiner 213. The direction dependent weight determiner 213 may be configured to receive the DOA estimate, the selected microphone information and the selected reference microphone information. For example the DOA estimate, the selected microphone information and the selected reference microphone information may be received from the reference microphone selector 209. The direction dependent weight determiner 213 may furthermore be configured to generate direction dependent weighting factors $w_i$ from this information. The weighting factors $w_i$ may be determined as a function of the distance between the microphone location and the DOA. Thus for example the weighting function may be calculated as $$w_i=c_i$$

In such embodiments the weighting function naturally enhance the audio signals from microphones which are closest (nearest) to the DOA and thus may avoid possible artefacts where the source is moving relative to the capturing apparatus and 'rotating' around the microphone array and causing the selected microphone to change. In some embodiments the weighting function may be determined from the algorithm presented in V. Pulkki, "Virtual source positioning using vector base amplitude panning," J. Audio Eng. Soc., vol. 45, pp. 456-466, June 1997. The weights may be passed to the signal generator 215.

In some embodiments the nearest microphone selector, the reference microphone selector and the direction dependent weight determiner may be at least partially pre-determined or computed beforehand. For example all the required information such as the selected microphone triangle, the reference microphone, and the weighting gains can be fetched or retrieved from a table using the DOA as an input.

In some embodiments of the mid signal generator may comprise a signal generator 215. The signal generator 215 may be configured to receive the selected microphone audio signals and the coherence delay values from the coherence delay determiner and direction dependent weights from the direction dependent weight determiner 213.

The signal generator 215 may comprise a signal time aligner or signal alignment means which in some embodiments applies the determined delays to the non-reference microphone audio signals to time align the selected microphone audio signals.

Furthermore in some embodiments the signal generator 215 may comprise a multiplier or weight application means configured to apply the weighting function $w_i$ to the time aligned audio signals.

Finally the signal generator 215 may comprise a summer or combiner configured to combine the time aligned (and in some embodiments directionally weighted) selected microphone audio signals.

The resulting mid signal may be represented as $$X_m(k)=w_3X_3(k)+w_2X_2(k)e^{-i2\pi k\tau_2/K}+w_1X_1(k)e^{-i2\pi k\tau_1/K}$$

where K is the discrete Fourier transform (DFT) size. The resulting mid signal can be reproduced using any known method, for example similar to conventional SPAC by applying a HRTF rendering based on the DOA.

The output, the mid signal, may then be output. The mid signal output may be stored or processed as required.

Figure 3:
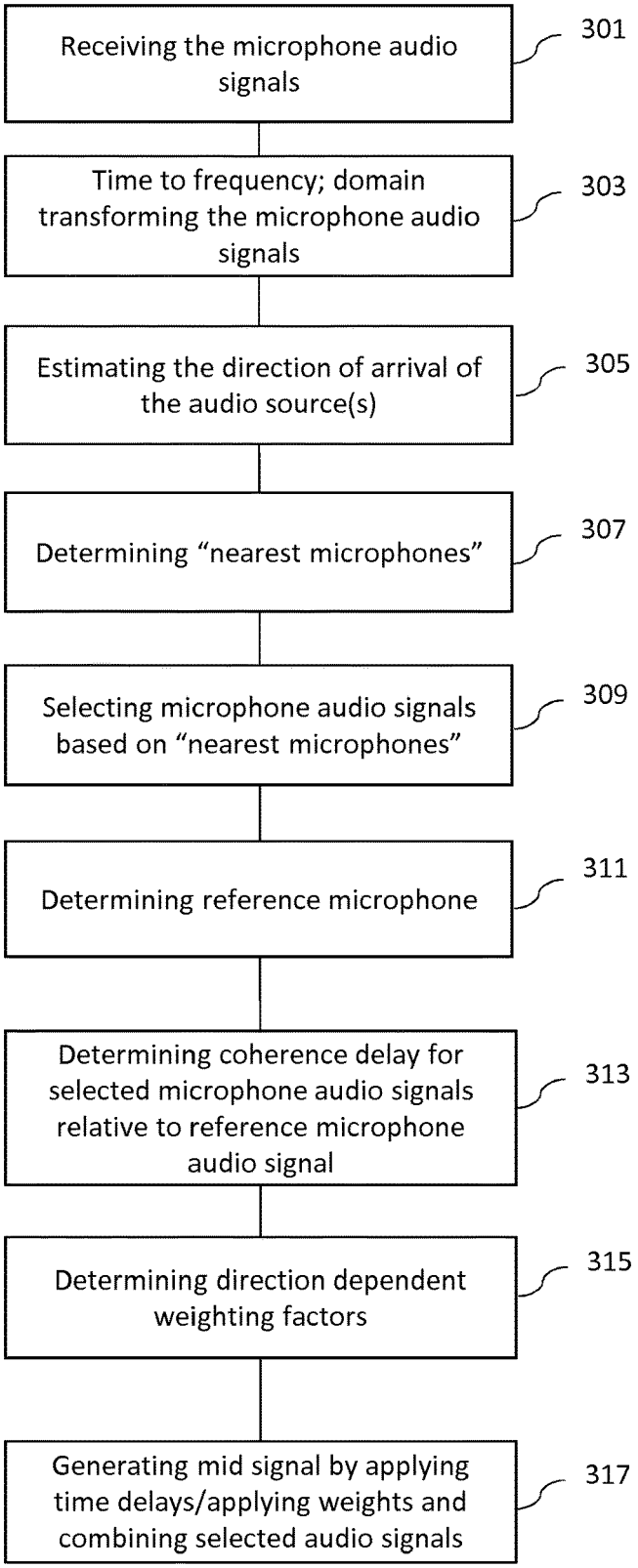
FIG. 3 shows a flow diagram of the operation of the mid signal generator as shown in FIG. 2.

With respect to FIG. 3 an example flow chart showing the operation of the mid signal generator shown in FIG. 2 is shown in further detail.

As described herein the mid signal generator may be configured to receive the microphone signals from the microphones or from the analogue-to-digital converter (when the audio signals are live), or from the memory (when the audio signals are stored or previously captured) or from a separate capture apparatus.

The operation of receiving the microphone audio signals is shown in FIG. 3 by step 301.

The received microphone audio signals are transformed from the time to frequency domain.

The operation of transforming the audio signals from the time domain to the frequency domain is shown in FIG. 3 by step 303.

The frequency domain microphone signals may then be analysed to estimate the direction of arrival of audio sources within the audio scene.

The operation of estimating the direction of arrival of audio sources is shown in FIG. 3 by step 305.

Following the estimation of the direction of arrival the method may further comprise determining (the nearest) microphones. As discussed herein the nearest microphones to the audio source may be defined as the triangle (three) microphones and their associated audio signals. However any number of nearest microphones may be determined for selection.

The operation of determining the nearest microphones is shown in FIG. 3 by step 307.

The method may then further comprise selecting the audio signals associated with the determined nearest microphones.

The operation selecting the nearest microphone audio signals is shown in FIG. 3 by step 309.

The method may further comprise determining from the nearest microphones the reference microphone. As described previously the reference microphone may be the microphone nearest to the audio source.

The operation of determining the reference microphone is shown in FIG. 3 by step 311.

The method may then further comprise determining a coherence delay for the other selected microphone audio signals with respect to the selected reference microphone audio signal.

The operation of determining a coherence delay for the other selected microphone audio signals with respect to the reference microphone audio signal is shown in FIG. 3 by step 313.

The method may then further comprise determining direction dependent weighting factors associated with each of the selected microphone audio signals.

The method of determining direction dependent weighting factors associated with each of the selected microphone channels is shown in FIG. 3 by step 315.

The method may furthermore comprise the operation of generating the mid signal from the selected microphone audio signals. The operation of generating the mid signal from the selected microphone audio signals may be subdivided three operations. The first sub-operation may be time aligning the other or further selected microphone audio signals with respect to the reference microphone audio signal by applying the coherence delays to the other selected microphone audio signals. The second sub-operation may be applying the determined weighting functions to the selected microphone audio signals. The third sub-operation may be summing or combining the time aligned and optionally weighted selected microphone audio signals to form the mid signal. The mid signal may then be output.

The operation of generating the mid signal from the selected microphone audio signals (and which may comprise the operations of time aligning, weighting and combining the selected microphone audio signals) is shown in FIG. 3 by step 317.

Figure 4:
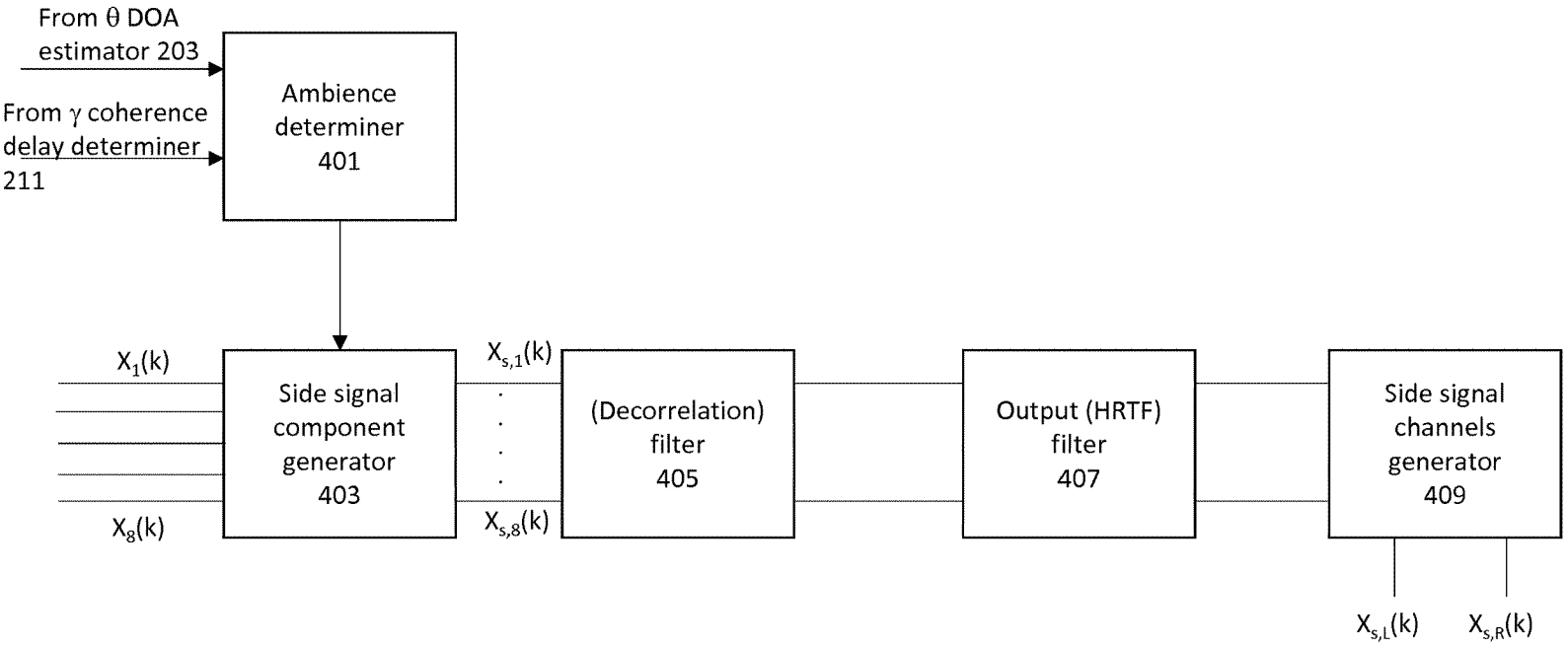
FIG. 4 shows schematically a side signal generator for a spatial audio signal processor according to some embodiments.

With respect to FIG. 4 a side signal generator according to some embodiments is shown in further detail. The side signal generator is configured to receive the microphone audio signals (either time or frequency domain versions) and based on these determine the ambience component of the audio scene. In some embodiments the side signal generator may be configured to generate direction of arrival (DOA) estimations of audio sources in parallel with the mid signal generator, however in the following examples the side signal generator is configured to receive the DOA estimates. Similarly in some embodiments the side signal generator may be configured to perform microphone selection, reference microphone selection and coherence estimation independently and separate from the mid signal generator. However in the following example the side signal generator is configured to receive the determined coherence delay values.

In some embodiments the side signal generator may be configured to perform microphone selection and thus respective audio signal selection dependent on the actual application the signal processor is being employed in. For example where the output is one adapted to signal process audio signals for binaural reproduction the side signal generator may select the audio signals from all of the plurality of microphones for the generation of the side signals. On the other hand, for example where the output is adapted for loudspeaker reproduction, the side signal generator may be configured to select the audio signals from the plurality of microphones such that number of audio signals would be equal to the number of the loudspeakers, and the audio signals selected such that the respective microphones would be directed or distributed all around the device (rather than from a limited region or orientation). In some embodiments where there are many microphones, the side signal generator may be configured to select only some of the audio signals from the plurality of microphones in order to decrease the computational complexity of the generation of the side signals. In such an example the selection of the audio signals may be made such that the respective microphones are "surrounding" the apparatus.

In such a manner whether all of the audio signals or only some of the audio signals from the plurality of microphones are selected the side signal is in these embodiments generated from respective audio signals from microphones not only on the same side (in contrary to the mid signal creation).

In the embodiments as described herein the respective audio signal from (two or more) microphones are selected for the side signal creation. This selection may as described above be made based on the microphone distribution, the output type (e.g. whether earphone or loudspeaker) and other characteristics of the system such as the computational/memory capacity of the apparatus.

In some embodiments the audio signals selected for the mid signal generation operations described above and the generation of the side signals below may be the same, have at least one signal in common or may have no signals in common. In other words in some embodiments the mid signal channel selector may provide the audio signals for the generation of the side signals. However it is understood that the respective audio signals selected for the generation of the mid signal and the side signals may share at least some of the same audio signals from the microphones.

In other words in some embodiments it may be possible to use the audio signals from the same microphones for the mid signal creation as well as other audio signals from further microphones for the side signal.

Furthermore in some embodiments the side signal selection may select audio signals which are not any of the audio signals selected for the generation of the mid signal.

In some embodiments the minimum number of audio signals/microphones selected for the generated side signal is 2. In other words at least two audio signals/microphones are used to generate the side signals. For example, assuming there are 3 microphones in total in the apparatus and the audio signals from microphone 1 and microphone 2 (as selected) are used to generate the mid signal, the selection possibilities for the side signal generation may be (microphone 1, microphone 2, microphone 3) or (microphone 1, microphone 3) or (microphone 2, microphone 3). In such an example using all three microphones would produce the 'best' side signals.

In the example where only two audio signals/microphones are selected, the selected audio signals would be duplicated, and the target directions would be selected to cover the whole sphere. Thus for example where there are two microphones located at ±90 degrees. The audio signal associated with the microphone at −90 degrees would be converted into three exact copies, and the HRTF pair filters as discussed later for these signals would for example be selected to be, −30, −90, and −150 degrees. Correspondingly, the audio signal associated with the microphone at +90 degrees would be converted into three exact copies, and the HRTF pair filters for these signals would for example be selected to be +30, +90, and +150 degrees.

In some embodiments the audio signals associated with the 2 microphones are processed for example such that the HRTF pair filters for them would be at ±90 degrees.

The side signal generator in some embodiments is configured to comprise an ambience determiner 401. The ambience determiner 401 in some embodiments is configured to determine an estimate of the portion of the ambience or side signal which should be used from each of the microphone audio signals. The ambience determined may thus be configured to estimate an ambience portion coefficient.

This ambience portion coefficient or factor may in some embodiments be derived from the coherence between the reference microphone and the other microphones. For example a first ambience portion coefficient g' may be determined based on $$g'_a=\sqrt{1-\max\gamma_i}$$

where $\gamma_i$ is the coherence between the reference microphone and the other microphones with the delay compensation.

In some embodiments the ambience portion coefficient estimate g" can be obtained using the estimated DOAs by computing circular variance over time and/or frequency.

$$g''_a=\sqrt{1-\left|\frac{1}{N}\sum_{n=1}^{N}\theta_n\right|}$$

where N is the number of used DOA estimates $\theta_n$.

In some embodiments the ambience portion coefficient estimate g may be a combination of these estimates.

$$g_a=\max(g'_a,g''_a)$$

The ambience portion coefficient estimate g (or g' or g") may be passed to a side signal component generator 403.

In some embodiments the side signal generator comprises a side signal component generator 403. The side signal component generator 403 is configured to receive the ambience portion coefficient values g from the ambience determiner 401 and the frequency domain representations of the microphone audio signals. The side signal component generator 403 may then generate side signal components using the following expression $$X_{s,i}(k)=g_a X_i(k)$$

These side signal components can then be passed to a filter 405.

Although the determination of the ambience portion coefficient estimate is shown having been determined within the side signal generator, it is understood that in some embodiments the ambient coefficient may be obtained from the mid signal creation.

In some embodiments the side signal generator comprises a filter 405. The filter in some embodiments may be a bank of independent filters each configured to produce a modified signal. For example two signals that are perceived substantially similar based on the spatial impression as being two incoherent signals, when reproduced over different channels of an earphone. In some embodiments the filter may be configured to generate a number of signals producing perceived substantially similar based on the spatial impression when reproduced over a multiple channel speaker system.

The filter 405 may be a decorrelation filter. In some embodiments one independent decorrelator filter receives one side signal as an input, and produces one signal as an output. The processing is repeated for each side signal, such that there may be an independent decorrelator for each side signal. An example implementation of a decorrelation filter is one of applying different delays at different frequencies to the selected side signal components.

Thus in some embodiments the filter 405 may comprise two independent decorrelator filters configured to produce two signals that are perceived substantially similar based on the spatial impression as being two incoherent signals, when reproduced over different channels of earphones. The filter may be a decorrelator or a filter providing decorrelator functionality.

In some embodiments the filter may be a filter configured to applying different delays to the selected side signal components wherein the delays applied to the selected side signals components are dependent on frequency.

The filtered (decorrelated) side signal components may then be passed to a head related transfer function (HRTF) filter 407.

In some embodiments the side signal generator may optionally comprise an output filter 407. However in some embodiments the side signal generator may be output without an output filter.

The output filter 407 may, for an earphone related optimised example, comprise a head related transfer function (HRTF) filter pair (one associated with each earphone channel) or a database of the filter pairs. In such embodiments each filtered (decorrelated) signal is passed to unique HRTF filter pairs. These HRTF filter pairs are selected in a way, that their respective directions suitably cover the whole sphere around the listener. The HRTF filter (pair) thus creates a perception of envelopment. Moreover, the HRTF for each side signal is selected in way that the direction of it is close to the direction of the corresponding microphone in the audio capturing apparatus microphone array. Thus as a result, the processed side signals have a degree of directionality due to acoustic shadowing of the capture apparatus. In some embodiments the output filter 407 may comprise a suitable multichannel transfer function filter set. In such embodiments the filter set comprises a number of filters or a database of filters which are selected in a way that their directions may substantially cover the whole sphere around the listener in order to create a perception of envelopment.

Furthermore in some embodiments these HRTF filter pairs are selected in a way that their respective directions substantially or suitably evenly cover the whole sphere around the listener, such that the HRTF filter (pair) creates the perception of envelopment.

The output of the output filter 407, such as the HRTF filter pair (for earphone outputs) is passed to a side signal channels generator 409 or may be directly output (for multichannel speaker systems).

In some embodiments of the side signal generator comprises a side signal channels generator 409. The side signal channels generator 409 may for example receive the outputs from the HRTF filter and combine these to generate the two side signals. For example in some embodiments the side signal channels generator may be configured to generate a left side and right side channel audio signals. In other words the decorrelated and HRTF filtered side signal components may be combined such that they yield one signal for the left ear and one for the right ear.

Similarly for multi-channel loudspeaker playback. The output signals from the filter 405 can directly be reproduced with a multi-channel loudspeaker setup, where the loudspeakers may be 'positioned' by the output filter 407. Or in some embodiments the actual loudspeakers may be 'positioned'.

The resulting signals may thus be perceived to be spacious and enveloping ambient and/or reverberant-like signals with some directionality.

Figure 5:
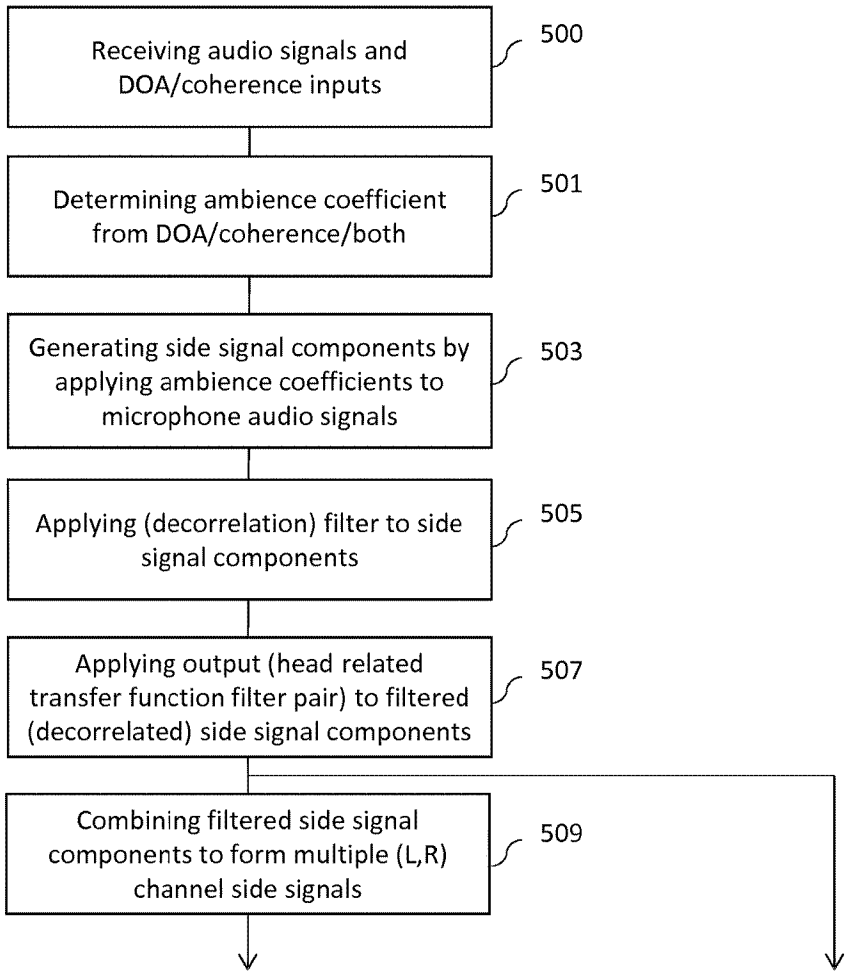
FIG. 5 shows a flow diagram of the operation of the side signal generator as shown in FIG. 4.

With respect to FIG. 5 a flow diagram of the operation of the side signal generator as shown in FIG. 4 is shown in further detail.

The method may comprise receiving the microphone audio signals. In some embodiments the method further comprises receiving coherence and/or DOA estimates.

The operation of receiving the microphone audio signals (and optionally the coherence and/or DOA estimates) is shown in FIG. 5 by step 500.

The method further comprises determining ambience portion coefficient values associated with the microphone audio signals. These coefficient values may be generated based on coherence, direction of arrival or both types of estimates.

The operation of determining the ambience portion coefficient values is shown in FIG. 5 by step 501.

The method further comprises generating side signal components by applying the ambience portion coefficient values to the associated microphone audio signals.

The operation of generating side signal components by applying the ambience portion coefficient values to the associated microphone audio signals is shown in FIG. 5 by step 503.

The method further comprises applying a (decorrelation) filter to the side signal components.

The operation of (decorrelation) filtering the side signal components is shown in FIG. 5 by step 505.

The method further comprises applying an output filter such as a head related transfer function filter pair (for earphone output embodiments) or a multichannel loudspeaker transfer filter to the decorrelated side signal components.

The operation of applying an output filter, such as a head related transfer function (HRTF) filter pair to the decorrelated side signal components is shown in FIG. 5 by step 507. It is understood that in some embodiments these output filtered audio signals are output, for example where the side audio signals are generated for multichannel speaker systems.

Furthermore the method may comprise, for the earphone based embodiments, the operation of summing or combining the HRTF and decorrelated side signal components to form left and right earphone channel side signals.

The operation of combining the HRTF filtered side signal components to generate the left and right earphone channel signals is shown in FIG. 5 by step 509.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. Apparatus comprising:

an audio capture application configured to determine a reference microphone signal from a plurality of microphones, wherein the reference microphone signal is provided from a reference microphone being closer to a sound source compared to at least one other microphone during an audio capturing, wherein the audio capture application is configured to select one or more microphones from the plurality of microphones based on the determined reference microphone so as to obtain one or more microphone signals, wherein the reference microphone and the one or more microphones are adaptively selected depending on the sound source position during the audio capturing, wherein the audio capture application is configured to determine delays between the selected one or more microphone signals and the reference microphone signal so as to time align each of the selected one or more microphone signals with the reference microphone signal, wherein the audio capture application is configured to process each microphone signal by a respective gain value, wherein the respective gain value is determined for each microphone position relative to the sound source during the audio capturing, wherein the audio capture application is configured to combine time aligned and processed microphone signals; and a signal generator configured to generate a mid signal based on the combined time aligned and processed microphone signals.

2. The apparatus as claimed in claim 1, wherein the audio capture application is further configured to:

identify two or more microphones from the plurality of microphones based on the determined direction and a microphone orientation such that the two or microphones identified are the microphones closest to the at least one audio source;

select based on the identified two or more microphones the two or more respective audio signals; and identify from the two or microphones identified which microphone is closest to the at least one audio source based on the determined direction and configured to select the microphone closest to the at least one audio source respective audio signal as the reference audio signal.

3. The apparatus as claimed in claim 2, wherein the audio capture application is further configured to determine a coherence delay between the reference audio signal and others of the selected two or more respective audio signals, wherein the coherence delay is the delay value which maximises the coherence between the reference audio signal and another of the two or more respective audio signals.

4. The apparatus as claimed in claim 1, wherein the signal generator is configured to:

time align the others of the selected two or more respective audio signals with the reference audio signal based on the determined coherence delay;

combine the time aligned others of the selected two or more respective audio signals with the reference audio signal; and generate a weighting value based on the difference between a microphone direction for the two or more respective audio signals and the determined direction, and further configured to apply the weighting value to the respective two or more audio signals prior to the signal generator combining.

5. The apparatus as claimed in claim 1, further comprising a further signal generator configured to further select from the plurality of microphones, a further selection of two or more respective audio signals and generate from a combination of the further selection of two or more respective audio signals at least two side signals representing an audio scene ambience.

6. The apparatus as claimed in claim 5, wherein the further signal generator is configured to select the further selection of two or more respective audio signals based on at least one of:

an output type; and a distribution of the plurality of microphones.

7. The apparatus as claimed in claim 5, wherein the further signal generator is configured to:

determine an ambience coefficient associated with each of the further selection of two or more respective audio signals;

apply the determined ambience coefficient to the further selection of two or more respective audio signals to generate a signal component for each of the at least two side signals; and decorrelate the signal component for each of the at least two side signals.

8. The apparatus as claimed in claim 5, wherein the further signal generator is configured to:

apply a pair of head related transfer function filters; and combine the filtered decorrelated signal components to generate the at least two side signals representing the audio scene ambience; and generate filtered decorrelated signal components to generate a left and a right channel audio signal representing the audio scene ambiance.

9. The apparatus as claimed in claim 5, wherein the ambience coefficient for an audio signal from the further selection of two or more respective audio signals is based on a coherence value between the audio signal and the reference audio signal.

10. The apparatus as claimed in claim 5, wherein the ambience coefficient for an audio signal from the further selection of two or more respective audio signals is based on at least one of:

a determined circular variance over time and/or frequency of a direction of arrival from the at least one audio source; and both a coherence value between the audio signal and the reference audio signal and a determined circular variance over time and/or frequency of a direction of arrival from the at least one audio source.

11. A method comprising:

determining a reference microphone signal from a plurality of microphones, wherein the reference microphone signal is provided from a reference microphone being closer to a sound source compared to at least one other microphone during an audio capturing;

selecting one or more microphones from the plurality of microphones based on the determined reference microphone so as to obtain one or more microphone signals, wherein the reference microphone and the one or more microphones are adaptively selected depending on the sound source position during the audio capturing;

determining delays between the selected one or more microphone signals and the reference microphone signal so as to time align each of the selected one or more microphone signals with the reference microphone signal;

processing each microphone signal by a respective gain value, wherein the respective gain value is determined for each microphone position relative to the sound source during the audio capturing;

and combining time aligned and processed microphone signals to generate a mid signal.

12. The method as claimed in claim 11, wherein adaptively selecting, comprises:

identifying two or more microphones from the plurality of microphones based on the determined direction and a microphone orientation such that the two or microphones identified are the microphones closest to the at least one audio source; and selecting based on the identified two or more microphones the two or more respective audio signals.

13. The method as claimed in claim 12, wherein adaptively selecting, further comprises:

identifying from the two or microphones identified which microphone is closest to the at least one audio source based on the determined direction; and selecting, from the two or more respective audio signals, a reference audio signal to select an audio signal associated with the microphone closest to the at least one audio source as the reference audio signal.

14. The method as claimed in claim 13, further comprising determining a coherence delay between the reference audio signal and others of the selected two or more respective audio signals, wherein the coherence delay is the delay value which maximises the coherence between the reference audio signal and another of the two or more respective audio signals.

15. The method as claimed in claim 14, wherein generating the mid signal comprises:

time aligning the others of the selected two or more respective audio signals with the reference audio signal based on the determined coherence delay; and combining the time aligned others of the selected two or more respective audio signals with the reference audio signal.

16. The method as claimed in claim 15, further comprising at least one of: generating a weighting value based on the difference between a microphone direction for the two or more respective audio signals and the determined direction, wherein generating the mid signal further comprises applying the weighting value to the respective two or more audio signals prior to the signal combiner combining; and summing the time aligned others of the selected two or more respective audio signals with the reference audio signal.

17. The method as claimed in claim 11, further comprising:

further selecting from the plurality of microphones, a further selection of two or more respective audio signals; and generating from a combination of the further selection of two or more respective audio signals at least two side signals representing an audio scene ambience.

18. The method as claimed in claim 17, wherein selecting the further selection of two or more respective audio signals comprises selecting the further selection of the two or more respective audio signals based on at least one of:

an output type; and a distribution of the plurality of microphones.

19. The method as claimed in claim 17, further comprising:

determining an ambience coefficient associated with each of the further selection of two or more respective audio signals;

applying the determined ambience coefficient to the further selection of the two or more respective audio signals to generate a signal component for each of the at least two side signals; and decorrelating the signal component for each of the at least two side signals.

* * * * *